US009021612B1

(12) United States Patent
O'Neal

(10) Patent No.: US 9,021,612 B1
(45) Date of Patent: May 5, 2015

(54) ASYMMETRIC BODY ARMOR

(71) Applicant: Robert T O'Neal, Phoenix, AZ (US)

(72) Inventor: Robert T O'Neal, Phoenix, AZ (US)

(73) Assignee: Armored Republic LLC, Phoenix, AZ (US)

( * ) Notice: Subject to any disclaimer, the term of this patent is extended or adjusted under 35 U.S.C. 154(b) by 15 days.

(21) Appl. No.: 13/944,691

(22) Filed: Jul. 17, 2013

Related U.S. Application Data

(60) Provisional application No. 61/774,002, filed on Mar. 7, 2013.

(51) Int. Cl.
*F41H 1/02* (2006.01)

(52) U.S. Cl.
CPC ..... *F41H 1/02* (2013.01)

(58) Field of Classification Search
USPC ..... 2/2.5, 463, 92, 97, 102, 464, 465, 467; 89/36.01, 36.02, 36.05
See application file for complete search history.

(56) References Cited

U.S. PATENT DOCUMENTS

| | | | | | |
|---|---|---|---|---|---|
| 1,250,197 | A | * | 12/1917 | Louppe | 2/2.5 |
| 2,468,841 | A | * | 5/1949 | Siegel | 2/463 |
| 3,162,861 | A | * | 12/1964 | Gustafson | 2/463 |
| 3,377,974 | A | * | 4/1968 | Jaskowski | 112/418 |
| 5,943,694 | A | * | 8/1999 | Moureaux et al. | 2/2.5 |
| 5,978,961 | A | * | 11/1999 | Barker | 2/2.5 |
| 6,233,737 | B1 | * | 5/2001 | Ditchfield et al. | 2/2.5 |

* cited by examiner

*Primary Examiner* — Tejash Patel
(74) *Attorney, Agent, or Firm* — Thomas W. Galvani, P.C.; Thomas W. Galvani

(57) ABSTRACT

Body armor includes a panel having a front, an opposed back, left and right sides, top and bottom, and a vertical axis extending through the panel at a location intermediate between the right and left sides. Opposed right and left shoulder cuts are formed in the panel between the right side and the top and between the left side and the top, and the right and left shoulder cuts are asymmetric to each other about the vertical axis. The right and left shoulder cuts are linear edges formed diagonally between the left and right sides and the top, and the right shoulder cut extends further inboard into the panel toward the vertical axis than the left shoulder cut.

20 Claims, 4 Drawing Sheets

ASYMMETRIC BODY ARMOR

CROSS-REFERENCE TO RELATED APPLICATIONS

This application claims the benefit of U.S. Provisional Application No. 61/774,002, filed Mar. 7, 2013, which is hereby incorporated by reference.

FIELD OF THE INVENTION

The present invention relates generally to ballistics, and more particularly to ballistic and blast-resistant body armor.

BACKGROUND OF THE INVENTION

From leather, heavy furs, and chain metal, body armor has evolved in complexity, strength, method of manufacture, and effectiveness against weapons. Modern body armor comes in a variety of different forms, including shields, helmets, and armor which protects the torso and limbs. Depending on the type, body armor may resist the impact of ballistic projectiles such as bullets, may cushion blows from hand-to-hand combat, may deaden impacts from small explosions, and may resist slashing or stabbing attacks from knives. Ballistic body armor typically protects against penetration and impact energy transmission.

Ballistic body armor is frequently fashioned from steel or other dense metals, causing it to be very heavy, stiff, and cumbersome to wear. Heavy-duty armor often consists of plates of metal which can restrict movement greatly due to stiffness and size. Torso body armor is generally carried in a vest or jacket as one or a few pieces of metal. The soldier wearing the body armor is generally carrying a weapon which he may need to fire, and due to the weight and rigidity of prior art body armor, carrying, shouldering, and firing the weapon can be difficult and cumbersome for the soldier. An improved type of body armor is needed.

SUMMARY OF THE INVENTION

According to the principle of the invention, body armor to be worn on a human torso includes a panel with a top and back, right and left sides, a top and bottom, a vertical axis extending intermediately through the panel with respect to the left and right sides, and opposed right and left shoulder cuts. The right shoulder cut extends between the right side and the top, and the left shoulder cut extends between the left side and the top. The right and left shoulder cuts are asymmetric to each other about the vertical axis, and the right shoulder cut extends deeper into the panel toward the vertical axis than the left shoulder cut extends into the panel toward the vertical axis. The left and right shoulder cuts are linear edges formed diagonally between the left and right sides and the top. The right shoulder cut is longer than the left shoulder cut, the right shoulder cut is oriented at approximately 26 degrees with respect to the right side, and the left shoulder cut is oriented at approximately 34 degrees with respect to the left side. The panel includes a rigid sheet of metal, an adhesive sheet applied in front of the rigid sheet of metal, an aramid fiber lining applied to the adhesive sheet, and a spall lining enveloping the body armor to mitigate the ejection of ballistic fragments.

BRIEF DESCRIPTION OF THE DRAWINGS

Referring to the drawings.

DETAILED DESCRIPTION

Figure 1:
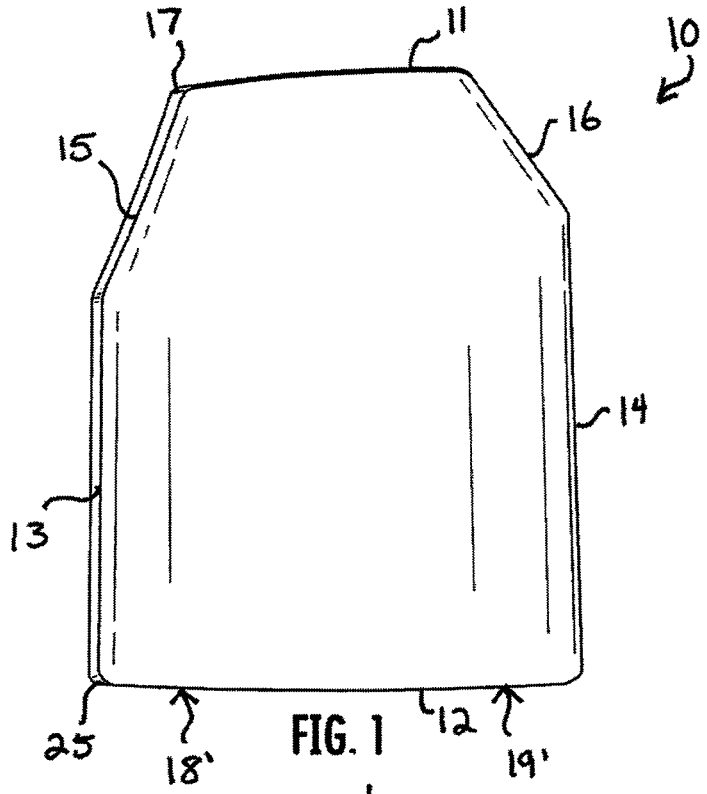
FIG. 1 is a front perspective view of body armor constructed according to the principle of the invention.
Figure 2:
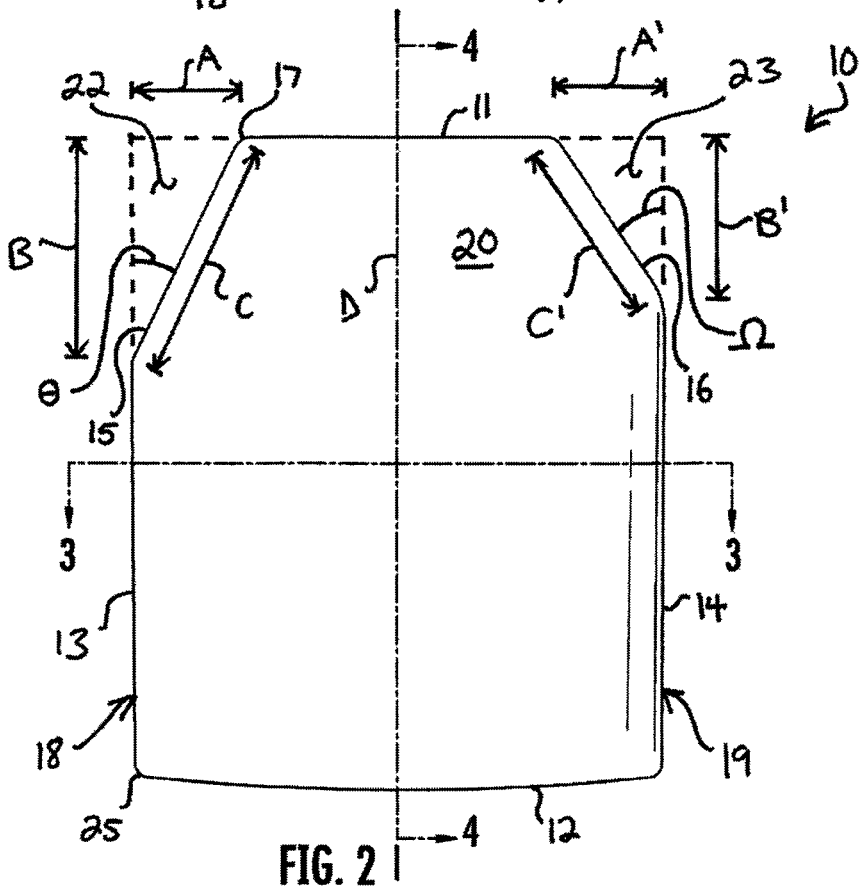
FIG. 2 is a front elevation view of the body armor of FIG. 1.

Reference now is made to the drawings, in which the same reference characters are used throughout the different figures to designate the same elements. FIG. 1 illustrates an item of body armor 10 constructed and arranged in accordance with the principle of the invention, and shown in a slight perspective view so as to illustrate the curvature of the body armor 10. FIG. 2 illustrates the body armor 10 in a front elevation view. The body armor 10 is configured to be worn on a human torso, applied into a vest, backpack, or other bag, and worn against the chest, the back, or both, and to protect the torso from ballistic impacts and explosive blasts. For purposes of clarity and consistency, when a user of the body armor 10 is described, the user will be identified as a soldier and as "he" or "him."

Figure 3:
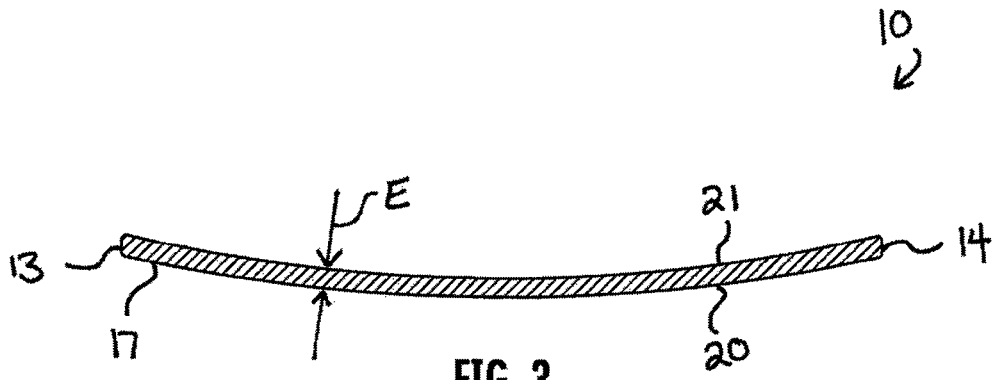
FIG. 3 is a section view of the body armor of FIG. 1 taken along the line 3-3 in FIG. 2.
Figure 4:
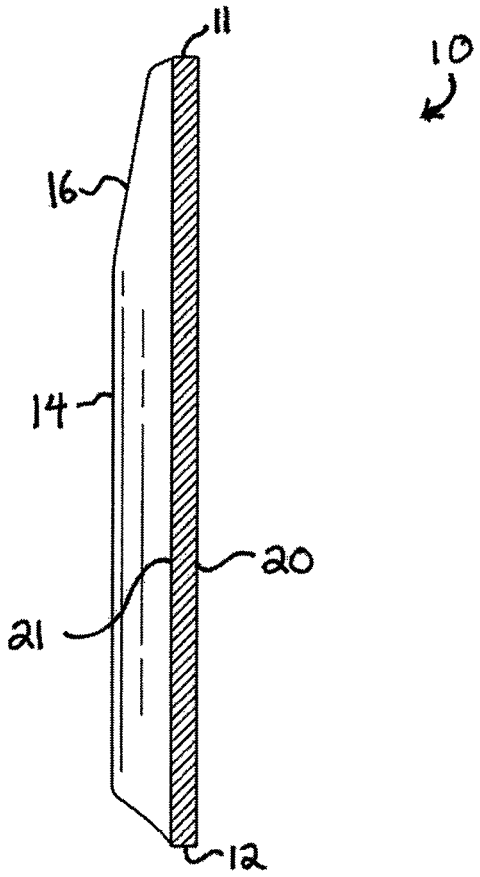
FIG. 4 is a section view of the body armor of FIG. 1 taken along the line 4-4 in FIG. 2.

The body armor 10 is a rigid panel 17 including a top 11, an opposed bottom 12, and sides 13 and 14 extending therebetween. For purposes of orientation, side 13 is considered a right side, and side 14 is considered a left side, because when the body armor 10 is worn by the soldier on his chest, the right side 13 of the body armor 10 is disposed over the right half of the soldier's torso and the left side 14 of the body armor 10 is disposed over the left half of the soldier's torso. When the soldier wears the body armor 10 on his back, this orientation is reversed, but one having ordinary skill in the art should readily appreciate this. The body armor 10 is generally sized to fit an adult male torso, and is approximately 12 inches (approximately 30.5 centimeters) tall between the top 11 and the bottom 12, and is approximately 10 inches (approximately 25.4 centimeters) wide between the opposed right and left sides 13 and 14. Although physical dimensions are provided throughout this description, it should be understood that the dimensions are preferred dimensions only and are not intended to limit the body armor 10 to one particular size. With reference to FIG. 3, which shows a section view of the body armor 10 bifurcating the body armor 10 along the line 3-3 in FIG. 2, the body armor 10 has a convex front face 20 and an opposed, concave back face 21, such that the panel 17 is generally convex in shape between the right and left sides 13 and 14.

The body armor 10 provides enhanced mobility to the soldier to hoist, shoulder, aim, and fire a weapon. The corners between the top 11 and each of the right and left sides 13 and 14 are cut. A right shoulder cut 15 is formed between the top 11 and the right side 13, and a left shoulder cut 16 is formed between the top 11 and the left side 14. The right shoulder cut 15 extends further, or deeper, into the panel 17 than the left shoulder cut 16, as will be explained. The right shoulder cut 15 is a linear edge extending generally diagonally straight between the top 11 and the right side 13. The right shoulder cut 15 begins at the top 11 a distance A away from the right side 13, as shown in FIG. 2. The distance A is preferably approximately 2 inches (approximately 5.1 centimeters). The right shoulder cut 15 extends diagonally down toward the right side 13, and terminates at the right side 13 a distance B away from the top 11, which is preferably approximately 4.125 inches (approximately 10.5 centimeters). The right shoulder cut 15 has a length C between the top 11 and the right side 13, which length C is preferably approximately 4.6 inches (approximately 11.7 centimeters). The right shoulder cut 15 is aligned obliquely to the right side 13 at an angle θ equal to between approximately 20 and 30 degrees, and the angle θ is preferably 26 degrees. In this embodiment, the right shoulder cut 15 defines a triangular area 22 at the top 11 and right side 13 of the body armor 10 having approximately 4.125 square inches (approximately 26.8 square centimeters) of space. The area 22 provides the soldier with room for mobility of the soldier's right arm during carrying, shouldering, and firing his weapon.

The left shoulder cut 16 forms an area 23 for the soldier's left arm. The area 23 is smaller than the area 22, and the body armor 10 thus provides greater protection at the soldier's left arm but allows for more mobility at the soldier's right arm. The left shoulder cut 16 formed between the top 11 and the left side 14 is a linear edge extending generally diagonally straight between the top 11 and the left side 14. The left shoulder cut 16 begins at the top 11 a distance A' away from the left side 14, as shown in FIG. 2. The distance A' is preferably approximately 2 inches (approximately 5.1 centimeters). The left shoulder cut 16 extends diagonally down toward the left side 14, and terminates at the left side 14 a distance B' away from the top 11, which distance B' is preferably approximately 3 inches (approximately 7.6 centimeters). The left shoulder cut 16 has a length C' between the top 11 and the left side 14, which length C' is preferably approximately 3.6 inches (approximately 9.1 centimeters). The left shoulder cut 16 is aligned obliquely to the left side 14 at an angle Ω equal to between approximately 30 and 40 degrees, and the angle Ω is preferably 34 degrees. In this embodiment, the left shoulder cut 16 defines an area 23 at the top 11 and left side 14 of the body armor 10 having approximately 3 square inches (approximately 19.5 square centimeters) of space. The area 23 provides the soldier with room for mobility of the soldier's left arm, though not as much as the area 22.

The body armor 10 illustrated in FIGS. 1-4 is an asymmetric, non-ambidextrous piece of body armor that is useful for a right-handed soldier who holds and fires his weapon with his right hand. A vertical axis D extending along the line 4-4 in FIG. 2 bifurcates the panel 17 into a right breast 18 and a left breast 19. The right breast 18 includes the panel 17 from between the top 11 and bottom 12 and from between the vertical axis D and the right side 13. The left breast 19 includes the panel 17 from between the top 11 and bottom 12 and from between the vertical axis D and the left side 14. The right shoulder cut 15 is larger and longer than the left shoulder cut 16, so that the right shoulder cut 15 is asymmetric to the left shoulder cut 16 about the vertical axis D, and extends further inboard into the panel 17 toward the vertical axis D than the left shoulder cut 16 extends inboard into the panel 17 toward the vertical axis D. As such, the right and left breasts 18 and 19 are also asymmetric with respect to each other about the vertical axis D. Moreover, the top 11, left shoulder cut 16, left side 14, bottom 12, right side 13, and right shoulder cut 15 cooperate to define a continuous peripheral edge 25 around the hexagonal panel 17. This peripheral edge 25 is asymmetric; the peripheral edge 25 along the right breast 18 is asymmetric to the peripheral edge 25 along the left breast 19.

One having ordinary skill in the art will readily appreciate that in other embodiments, the left shoulder cut 16 may be larger than the right shoulder cut 15, such as to accommodate a left-handed soldier who holds and fires his weapon with his left hand. In such an embodiment, the body armor would appear substantially as a mirror image of the body armor 10. The body armor 10 shown here, however, is for right-handed firing and is designed to be worn as such on the soldier's chest.

With reference to FIG. 3, the convex shape of the panel 17 of the body armor 10 can be seen, in which the front and back faces 20 and 21 bow outwardly between the right and left sides 13 and 14. The front and back faces 20 and 21 are generally parallel to each other and spaced slightly apart, so that the body armor 10 has a thickness E which is preferably equal to approximately 0.25 inches (approximately 0.64 centimeters). The radius of the convex inner face 21 is preferably approximately 19 inches (48.3 centimeters). As shown, the body armor 10 is preferably curved continuously between the right and left sides 13 and 14. In other embodiments, however, the panel 10 has four vertical, spaced-apart bends extending from the top 11 to the bottom 12, each defining an angle of between five and eight degrees, so that the panel 17 has the appearance of five vertical, continuous adjacent sections.

Figure 5:
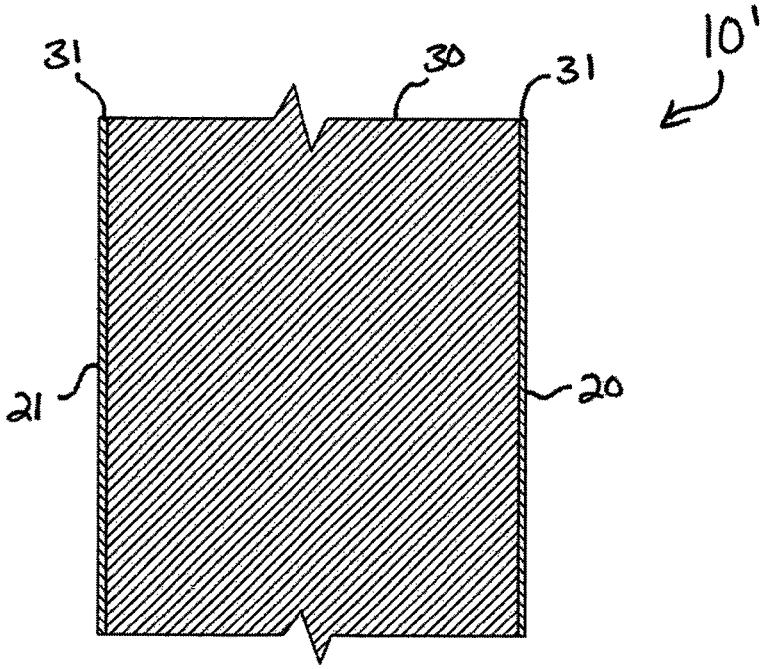
FIG. 5 is an enlarged section view of an embodiment of the body armor of FIG. 1 showing a detailed view of the construction of the embodiment of the body armor.
Figure 6:
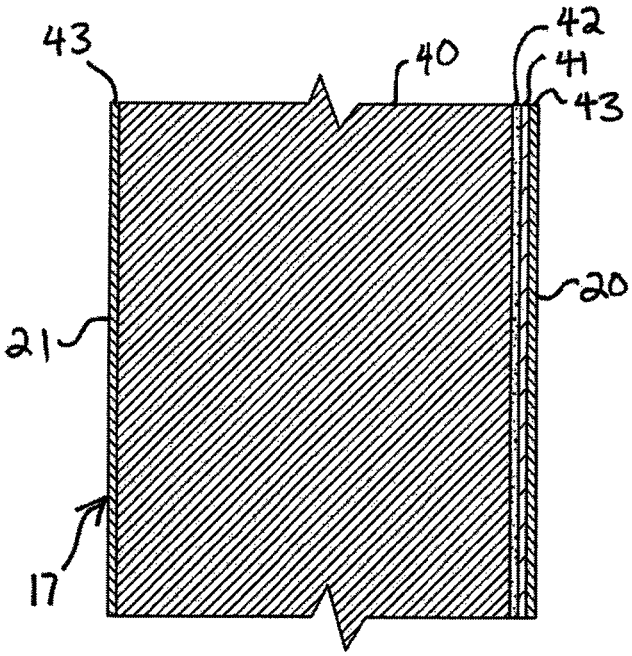
FIG. 6 is an enlarged section view of an embodiment of the body armor of FIG. 1 showing a detailed view of the construction of the embodiment of the body armor.

The body armor 10 is constructed from a material or composite combination of materials having strong, resilient, and impact-resistant material characteristics. In some single-material construction embodiments, the body armor 10 is constructed from a single material, while in other multiple-material construction embodiments, the body armor 10 is constructed from more than one material. Turning to FIGS. 5 and 6, section views taken along line 4-4 are enlarged to show a portion of embodiments of the body armor 10 and to illustrate the construction of those embodiments. FIG. 5 shows the single-material embodiment of the body armor 10, referred to there as body armor 10', and FIG. 6 shows the multiple-material embodiment of the body armor 10.

FIG. 5 illustrates the body armor 10' constructed from a single piece of material. FIG. 5 illustrates the body armor 10' in section view, and has slightly enlarged the constituent elements of the body armor 10—which would be difficult to see in an exact section view—only for clarity, and not to limit the body armor 10 in any way. Therefore, FIG. 5 is illustrative of the composition of the body armor 10' and of the general construction and arrangement of the features and structures, and one having skill in the art will readily appreciate that the relative sizes of the features and structures may be different. The body armor 10' includes a rigid sheet 30 of metal, such as steel, and preferably heat-treated, hardened, abrasion-resistant, and ballistic-resistant steel. A protective spall lining 31 is applied continuously over the sheet 30 of steel to protect against ultraviolet damage, chemical damage, water, general wear, and to prevent the ejection of ballistic fragmentation from the body armor 10'. The spall lining 31 is applied completely to both the front and back faces 20 and 21 so that the spall lining 31 continuously envelopes and encapsulates the sheet 30, so as to form a protective envelope on the body armor 10'. The spall lining 31 is shown in FIG. 5 thicker than it would proportionally be applied to the sheet 30 so as to clearly show the spall lining 31. In other embodiments, an enamel coat is applied over the spall lining for additional ultraviolet protection.

FIG. 6 illustrates the body armor 10 with a composite panel 17 constructed from several pieces of material. Like FIG. 5, FIG. 6 illustrates the body armor 10 in section view. The constituent elements of the body armor 10—which would be difficult to see in a proportional section view—have been enlarged slightly only for clarity of the illustration and not to limit the body armor 10 in any way. Therefore, FIG. 6 is illustrative of the composition of the body armor 10 and of the general construction and arrangement of the features and structures, and one having skill in the art will readily appreciate that sizes of the features and structures may be different; dimensions are provided below to enable one having skill in the art to make and use the body armor 10 as described. The body armor 10 includes a rigid sheet 40 of metal such as steel, and preferably heat-treated, hardened, abrasion-resistant, and ballistic-resistant steel. Applied to the front of the sheet 40 of steel is a flexible aramid fiber lining 41, such as is marketed under the brand name KEVLAR. The aramid lining 41 is coextensive with the sheet 40, and is a fabric with a high tensile strength-to-weight ratio to resist impacts. The aramid lining 41 is bonded continuously across the front of the sheet 40 with an adhesive sheet 42. One having reasonable skill in the art will readily appreciate that the aramid lining 41 can be applied to the front of the sheet 40 with adhesive, tape, or other similar application techniques which provide a continuous adherence of the lining 41 across the entire sheet 40.

A ballistic polyurethane spall lining 43, such as that manufactured by Line-X and marketed under the brand name PAX-CON, is applied to the front of the aramid lining 41 and to the back face 21 of the sheet 40 to prevent ejection of fragmented ballistics from the body armor 10. The spall lining 43 is applied directly on to the aramid lining 41 and the back face 21 of the sheet 40, such as by spraying, so as to completely encapsulate and continuously envelop the armor 10 and form stippling on the body armor 10, which stippling further reduces the likelihood of ballistic spalling on impact. The spall lining 41 also provides the body armor 10 with ultraviolet protection, chemical resistance, waterproofness, and general wear resistance.

A protective veneer or coat of enamel paint may be applied in an envelope over the body armor 10 to protect the body armor 10 against rust, UV damage, chemical damage, and general wear. In preferred embodiments, though, the spall lining 41 is applied over the entire body armor 10 without an external coat of enamel paint. The spall lining 41 on the back face 21 of the body armor 10 is approximately between 0.075 and 0.100 inches (approximately between 0.191 centimeters and 0.254 centimeters) thick, and the spall lining 41 on the front face 21 of the body armor 10 is approximately between 0.100 and 0.300 inches (approximately between 0.254 and 0.762 centimeters) thick. Additionally, the sheet 40 of steel is preferably 0.250 inches (0.635 centimeters) thick. In some embodiments, the sheet 40 of steel is thinner and provides protection against lower caliber or velocity ballistics, such as handguns. As discussed above, the aramid lining 41, adhesive sheet 42, and spall lining 43 are shown in FIG. 6 thicker than would be applied to the sheet 40 so as to clearly show each of those layered elements.

Figure 7:
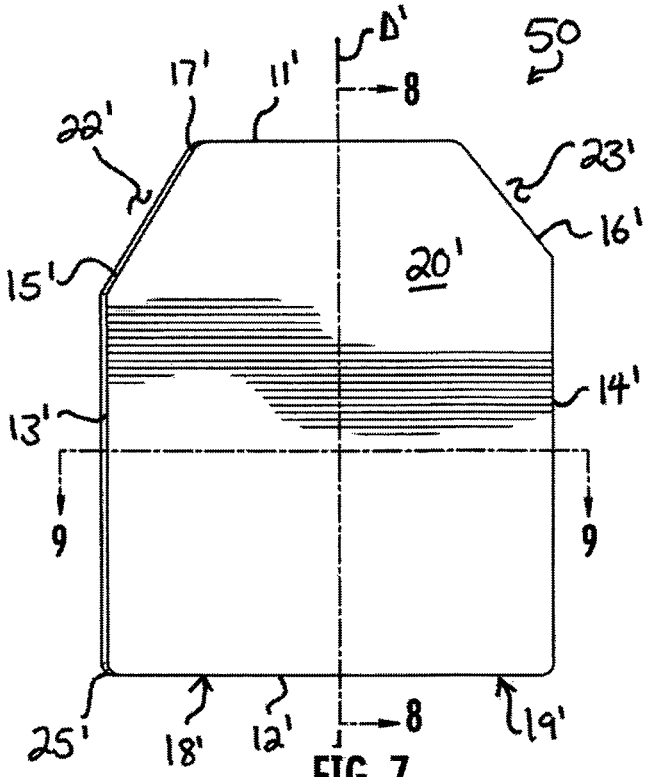
FIG. 7 is a front perspective view of a body armor constructed according to the principle of the invention.
Figure 8:
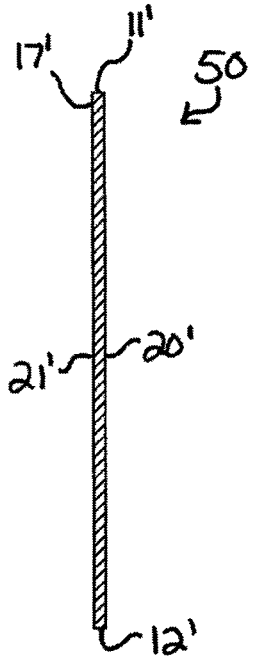
FIG. 8 is a section view of the body armor of FIG. 7 taken along the line 8-8 in FIG. 7.
Figure 9:
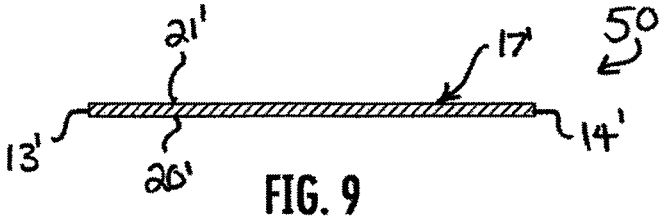
FIG. 9 is a section view of the body armor of FIG. 7 taken along the line 9-9 in FIG. 7.

Turning now to FIGS. 7, 8, and 9, shown there is a piece of body armor 50 substantially similar to the body armor 10 of FIGS. 1-6. The body armor 50 is flat plate body armor, and is identical to the body armor 10 in all respects other than the convex shape that the body armor 10 has, and as such the body armor 50 is marked with reference characters used to describe the body armor 10 but which are designated with a prime ("'") so as to distinguish those structural features from the features of the body armor 10. The body armor 50 includes a top 11', a bottom 12', right and left sides 13' and 14', a right shoulder cut 15', a left shoulder cut 16', a panel 17', right and left breasts 18' and 19', a front face 20', a back face 21', areas 22' and 23, a peripheral edge 25', and a vertical axis D'. The body armor 50 is flat and lies in a single plane between the top 11' and bottom 12' and between the sides 13' and 14'. Like the body armor 10, the body armor 50 is constructed from a material or composite combination of materials having strong, resilient, and impact-resistant material characteristics. One having ordinary skill in the art will readily appreciate that the body armor 50 is manufactured with either of the single-material construction, as described with reference to FIG. 5 and the body armor 10', and the multiple-material construction, as described with reference to FIG. 6 and the body armor 10.

Like the body armor 10, the body armor 50 is an asymmetric piece of body that includes a left shoulder cut 16' and a larger right shoulder cut 15'. Unlike the body armor 10, however, the body armor 50 is an ambidextrous piece of body armor that is used by either a right-handed soldier who holds and fires his weapon with his right hand, or by a left-handed soldier who holds and fires his weapon with his left hand. One having ordinary skill in the art will readily appreciate that in other embodiments, the left shoulder cut 16' may be larger than the right shoulder cut 15', such as to accommodate a left-handed soldier who holds and fires his weapon with his left hand. In such an embodiment, the body armor would appear substantially as a mirror image of the body armor 50. Moreover, because the body armor 50 is ambidextrous, the body armor 50 can be rotated, so that the front face 20' faces inward toward the soldier and the back face 21' faces outward away from the soldier, thus positioning the right shoulder cut 15' on the soldier's left side to provide room for mobility of the soldier's left arm, and positioning the left shoulder cut 16' on the soldier's right side.

Operation of the body armor 10 is now discussed, with the understanding that the discussion applies equally to body armors 10' and 50. In operation, the body armor 10 is slipped into a carrier pocket formed on the front of a vest or jacket and is useful for protecting the front of the soldier from ballistic impacts. The body armor 10 can also be slipped into a carrier pocket formed on the back of a vest or jacket and is useful there for protecting the back of the soldier from ballistic impacts. The right shoulder cut 15 provides the soldier with room between the top 11 and the right side 13 to carry, shoulder, and fire his weapon without impediment, as it allows for a greater range of motion than the left shoulder cut 16. The body armor 10 will withstand impact and defeat rounds up to 7.62×51 or .308 caliber at speeds of up to approximately 2780 feet per second (approximately 842 meters per second), and has a Type III armor level rating. The single-material construction embodiment of the body armor 10 defeats bullets, and the multiple-material construction embodiment of the body armor 10 defeats bullets and prevents ejection of spall or fragments of bullets.

The present invention is described above with reference to a preferred embodiment. However, those skilled in the art will recognize that changes and modifications may be made in the described embodiment without departing from the nature and scope of the present invention. To the extent that such modifications and variations do not depart from the spirit of the invention, they are intended to be included within the scope thereof.

Having fully and clearly described the invention so as to enable one having skill in the art to understand and practice the same, the invention claimed is:

1. Body armor to be worn on a human torso, the armor comprising:

a panel having a front and an opposed back, opposed right and left sides, and a top and an opposed bottom;

a vertical axis extending through the panel at a location intermediate with respect to the opposed right and left sides;

opposed curvilinear right and left shoulder cuts are formed in the panel between the right side and the top and between the left side and the top, respectively; and the right and left shoulder cuts are asymmetric to each other about the vertical axis.

2. The body armor according to claim 1, wherein the right shoulder cut extends further inboard into the panel toward the vertical axis than the left shoulder cut.

3. The body armor according to claim 1, wherein the left and right shoulder cuts are linear edges formed diagonally between the left side and the top, and between the right side and the top, respectively.

4. The body armor according to claim 3, wherein the right shoulder cut is longer than the left shoulder cut.

5. The body armor according to claim 3, wherein:

the right shoulder cut is oriented into the panel between approximately 20 degrees and approximately 30 degrees with respect to the right side; and the left shoulder cut is oriented into the panel between approximately 30 degrees and approximately 40 degrees with respect to the left side.

6. The body armor according to claim 3, wherein:

the right shoulder cut is oriented into the panel at approximately 26 degrees with respect to the right side; and the left shoulder cut is oriented into the panel at approximately 34 degrees with respect to the left side.

7. The body armor according to claim 1, wherein the panel comprises:

a rigid sheet of metal; and a spall lining enveloping the rigid sheet of metal.

8. The body armor according to claim 1, wherein the panel is composite and comprises:

a rigid sheet of metal;

an adhesive sheet applied in front of the rigid sheet of metal;

an aramid fiber lining applied in front of the adhesive sheet; and a spall lining enveloping the body armor.

9. Body armor to be worn on a human torso, the armor comprising:

a panel having a front and an opposed back, opposed left and right sides, and a top and an opposed bottom;

a curvilinear left shoulder cut extending between the left side and the top of the panel; and a curvilinear right shoulder cut extending between the right side and the top of the panel;

wherein the right shoulder cut is larger than the left shoulder cut.

10. The body armor according to claim 9, wherein the left and right shoulder cuts are linear edges formed diagonally between the left side and the top, and between the right side and the top, respectively.

11. The body armor according to claim 10, wherein:

the right shoulder cut is oriented into the panel between approximately 20 degrees and approximately 30 degrees with respect to the right side; and the left shoulder cut is oriented into the panel between approximately 30 degrees and approximately 40 degrees with respect to the left side.

12. The body armor according to claim 10, wherein:

the right shoulder cut is oriented into the panel at approximately 26 degrees with respect to the right side; and the left shoulder cut is oriented into the panel at approximately 34 degrees with respect to the left side.

13. The body armor according to claim 9, wherein the panel comprises:

a rigid sheet of metal; and a spall lining enveloping the rigid sheet of metal.

14. The body armor according to claim 9, wherein the panel is composite and comprises:

a rigid sheet of metal;

an adhesive sheet applied in front of the rigid sheet of metal;

an aramid fiber lining applied in front of the adhesive sheet; and a spall lining enveloping the body armor.

15. Body armor to be worn on a human torso, the armor comprising:

a panel including a rigid sheet of metal, the panel having a top and an opposed bottom, opposed left and right sides, and opposed left and right shoulder cuts extending between the left side and the top and between the right side and the top, respectively;

the top, bottom, left and right sides, and left and right curvilinear shoulder cuts cooperating to define a continuous peripheral edge of the panel;

a vertical axis extending through the panel at a location intermediate with respect to the opposed left and right sides;

the panel has a convex front and a concave back each extending between the left and right sides;

a right breast of the panel defined between the axis and the right side; and a left breast of the panel defined between the axis and the left side;

wherein the peripheral edge along the right breast of the panel is asymmetric to the peripheral edge along the left breast of the panel.

16. The body armor according to claim 15, wherein the right shoulder cut is larger than the left shoulder cut.

17. The body armor according to claim 15, wherein the panel further comprises:

an adhesive sheet applied in front of the rigid sheet of metal;

an aramid fiber lining applied in front of the adhesive sheet; and a spall lining enveloping the body armor.

18. The body armor according to claim 15, wherein:

the left and right shoulder cuts are each linear; and the panel is hexagonal.

19. The body armor according to claim 18, wherein:

the right shoulder cut is oriented into the panel between approximately 20 degrees and approximately 30 degrees with respect to the right side; and the left shoulder cut is oriented into the panel between approximately 30 degrees and approximately 40 degrees with respect to the left side.

20. The body armor according to claim 18, wherein:

the right shoulder cut is oriented into the panel at approximately 26 degrees with respect to the right side; and the left shoulder cut is oriented into the panel at approximately 34 degrees with respect to the left side.

* * * * *